US009915494B2

(12) United States Patent
Potts

(10) Patent No.: US 9,915,494 B2
(45) Date of Patent: Mar. 13, 2018

(54) BOW STABILIZER WITH HANDLE

(71) Applicant: Innovative Sales & Design, LLC, New Philadelphia, OH (US)

(72) Inventor: David Lee Potts, New Philadelphia, OH (US)

( * ) Notice: Subject to any disclaimer, the term of this patent is extended or adjusted under 35 U.S.C. 154(b) by 0 days.

(21) Appl. No.: 15/370,359

(22) Filed: Dec. 6, 2016

(65) Prior Publication Data

US 2017/0160043 A1 Jun. 8, 2017

Related U.S. Application Data

(60) Provisional application No. 62/264,458, filed on Dec. 8, 2015.

(51) Int. Cl.

| | |
|---|---|
| ***F41B 5/20*** | (2006.01) |
| ***F41B 5/14*** | (2006.01) |
| *F41C 33/08* | (2006.01) |

(52) U.S. Cl.

CPC ..... *F41B 5/1426* (2013.01); *F41B 5/148* (2013.01); *F41C 33/08* (2013.01)

(58) Field of Classification Search

CPC ..... F41B 5/00; F41B 5/14; F41B 5/1426
See application file for complete search history.

(56) References Cited

U.S. PATENT DOCUMENTS

| | | | | |
|---|---|---|---|---|
| 4,457,287 | A * | 7/1984 | Babington | F41B 5/10 124/23.1 |
| 5,992,403 | A * | 11/1999 | Slates | F41B 5/1426 124/89 |
| 6,092,516 | A * | 7/2000 | Martin | F41B 5/1426 124/88 |
| 9,038,617 | B1 * | 5/2015 | Khoshnood | F41B 5/1426 124/89 |
| 2015/0034063 | A1 * | 2/2015 | Bidigare | F41B 5/1426 124/89 |

* cited by examiner

*Primary Examiner* — John Ricci
(74) *Attorney, Agent, or Firm* — Dureska & Moore, LLC; Brent L. Moore

(57) ABSTRACT

A stabilizer for an archery bow capable of being removably attached to an archery bow. The stabilizer includes one or more weights removably attached to the stabilizer which provides dampening to the archery bow when the stabilizer is attached to the bow. The stabilizer can be locked at a position offset to the longitudinal length of the bow. The stabilizer includes a handle that enables the bow to be held or transported.

1 Claim, 7 Drawing Sheets

BOW STABILIZER WITH HANDLE

CROSS-REFERENCE TO RELATED APPLICATION

This application claims the benefit of U.S. Provisional Patent Application Ser. No. 62/264,458, filed Dec. 8, 2015.

BACKGROUND OF THE INVENTION

Technical Field

The invention relates generally to accessories for archery bows. More specifically, the invention is directed to a stabilizer for an archery bow that includes an integral handle that allows a user of the bow to hold or carry the bow utilizing the stabilizer handle. Moreover, the stabilizer dampens vibrations during use of the archery bow.

Background Art

Archery bows consist generally of a riser having a pair of ends. Each one of the ends of the riser is connected to a flexible arm. Each one of the flexible arms includes a generally outwardly extending split limb. A cam is rotatably mounted between the split limbs and a bowstring is strung around each one of the cams to complete the archery bow assembly. In addition, numerous accessories have been developed which can be installed on archery bows to aid a bow user in utilizing the bow.

One such accessory is a bow stabilizer. When used, modern archery bows create vibrations from the tension in the bow, which is transferred from the bow riser to the hand of the individual operating the bow. The transfer of the vibrations from the bow to the individual's hand has a detrimental effect on the accuracy of the individual aiming the bow and may potentially result in an inaccurate shot. The amplitude of the vibration in the bow can be affected by the design of the bow itself as well as the relative expertise of the individual operating the bow. Bow stabilizers are designed to aid in reducing vibrations caused by tension in the bow and to balance the bow in order to increase accuracy. Bow stabilizers that attach directly to the bow riser are generally well known in the art.

In addition, many accessories have been designed to aid a bow user in transporting or holding the bow during non-use. For example, the user can install a carrying strap on the bow by attaching the strap at each end of the pair of ends and sling the bow over the user's shoulder during transport or periods of non-use. While such accessories are suitable for temporarily holding or carrying the bow, the accessories often require the user to purchase additional bow components and/or uninstall the accessory each time the user utilizes the bow and reinstall the carrying strap during periods of non-use.

It is desirable to reduce the amount of accessories needed for a user to optimally utilize the bow as the more accessories needed, the greater the bow weight and the greater the cost associated with utilization of the bow.

Thus, a need exists for a bow stabilizer that overcomes the problems associated with prior art bow stabilizers and provides a stabilizer which dampens vibrations during use of the bow, as well as eliminates the need for additional accessories to aid users in transporting or holding the bow during periods of non-use. The bow stabilizer with integral carry handle of the present invention satisfies those needs by providing a stabilizer for an archery bow which not only dampens vibrations, but also includes an integral handle that allows users to carry or hold the bow during periods of non-use, thereby eliminating the need for a separate accessory to aid users in transporting or holding the bow and inconveniences thereof, and minimizing the overall bow weight.

BRIEF SUMMARY OF THE INVENTION

An objective of the present invention is to provide a bow stabilizer which dampens vibrations during use of the archery bow.

Another objective of the present invention is to provide a bow stabilizer that provides a means for users to hold or transport the bow.

Yet another objective of the present invention is to provide a bow stabilizer which minimizes additional accessories needed for a user to optimal utilize the bow.

Yet another objective of the present invention is to provide a bow stabilizer which reduces the overall weight of the bow.

These objectives and others are obtained by a bow stabilizer for an archery bow which includes a body capable of being removably attached to the archery bow, the body providing dampening to the archery bow when the body is removably attached to the archery bow, the body including a handle that enables the bow to be held or transported.

BRIEF DESCRIPTION OF THE SEVERAL VIEWS OF THE DRAWINGS

The preferred embodiment of the present invention, illustrative of the best mode in which Applicant has contemplated applying the principles of the invention, is set forth in the following description and is shown in the drawings, and is particularly and distinctly pointed out and set forth in the claims.

Similar numerals refer to similar parts throughout the drawings.

DETAILED DESCRIPTION OF THE INVENTION

Figure 6:
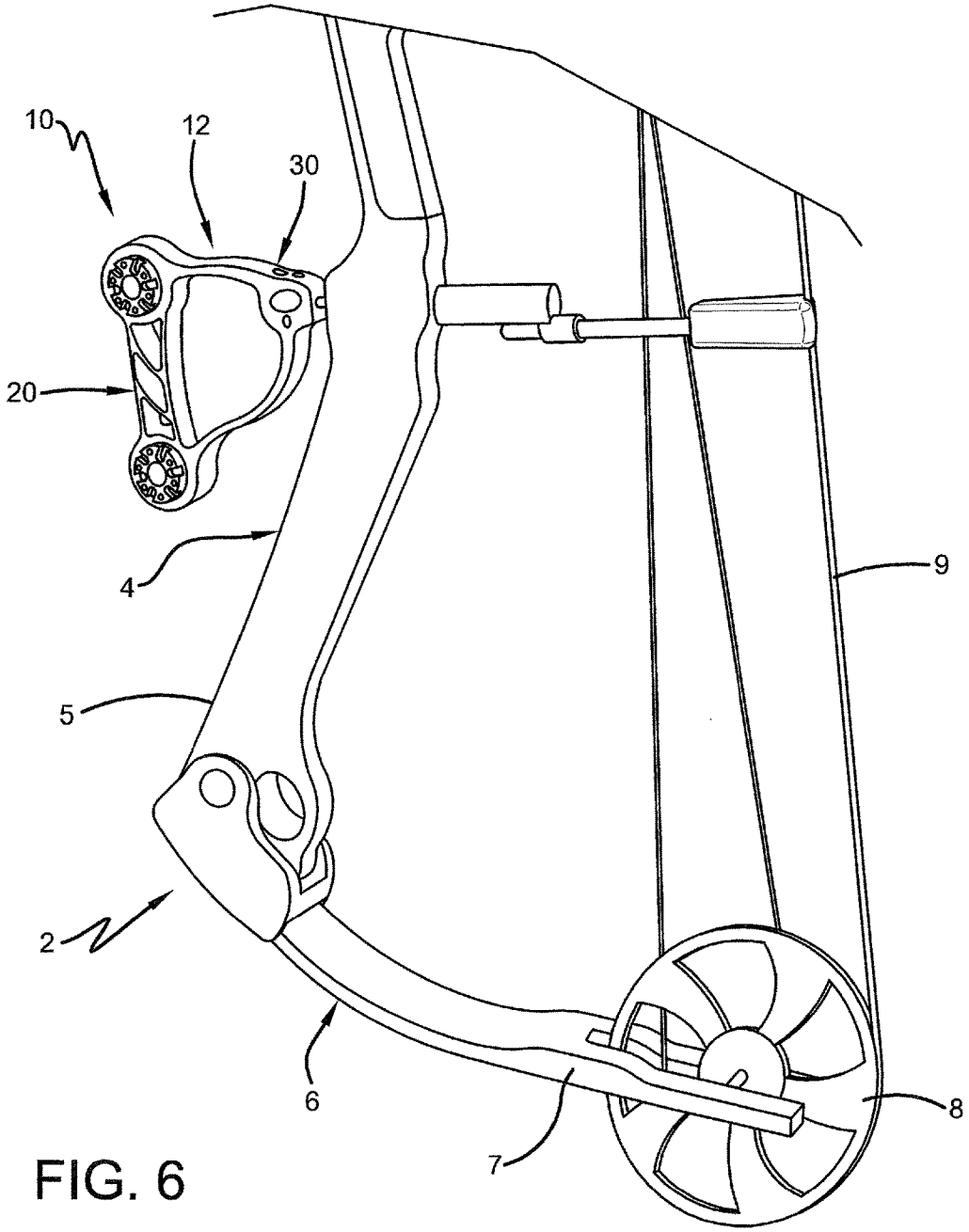
FIG. 6 is a fragmentary perspective view of the exemplary embodiment bow stabilizer with integral handle of the present invention shown in FIG. 1, showing the bow stabilizer mounted on an archery bow.
Figure 7:
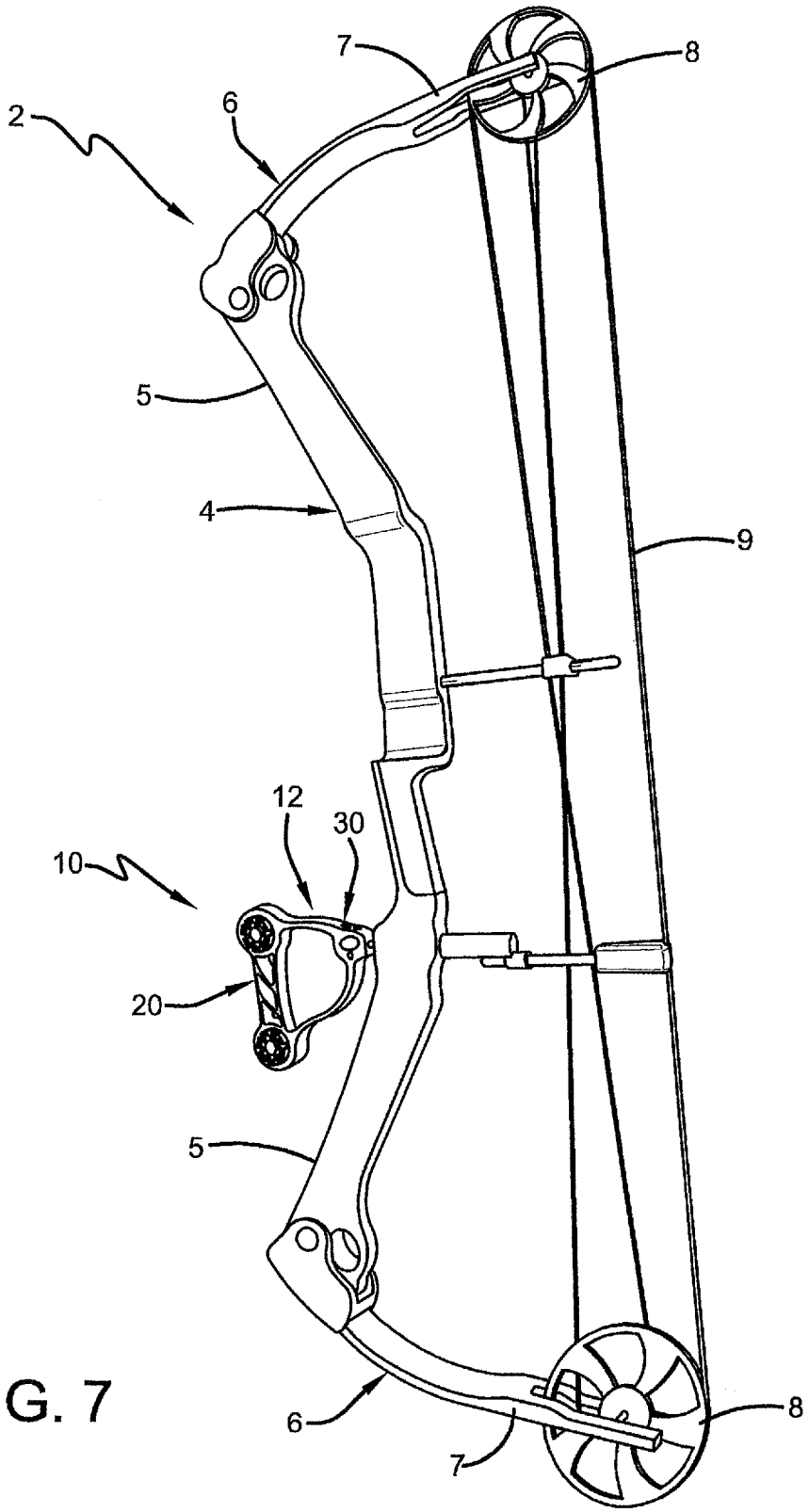
FIG. 7 is a fragmentary perspective view similar to FIG. 6.

In order to better understand the bow stabilizer of the present invention and the environment in which it operates, a prior art archery bow on which an exemplary embodiment bow stabilizer of the present invention is installed, is shown in FIGS. 6-7 and is indicated generally at 2. Archery bow 2 includes a riser 4 having a pair of ends 5. Each one of pair of ends 5 of riser 4 is connected to a flexible arm 6. Each one of flexible arms 6 includes a generally outwardly extending split limb 7. A cam 8 is rotatably mounted between split limb 7 and a bowstring 9 is strung around each one of cams 8 to complete the archery bow assembly.

Figure 1:
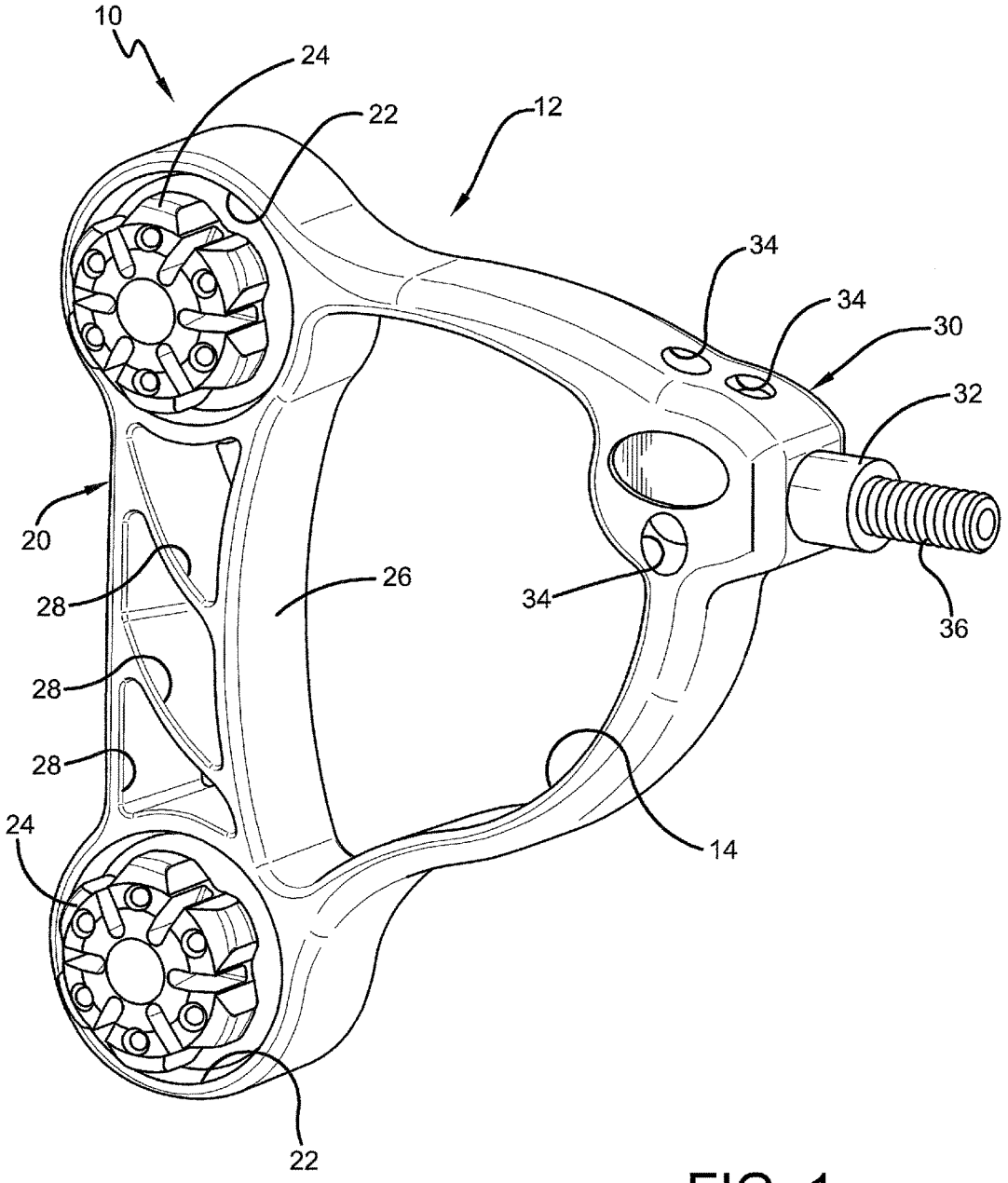
FIG. 1 is a perspective view of an exemplary embodiment bow stabilizer with integral handle of the present invention.
Figure 2:
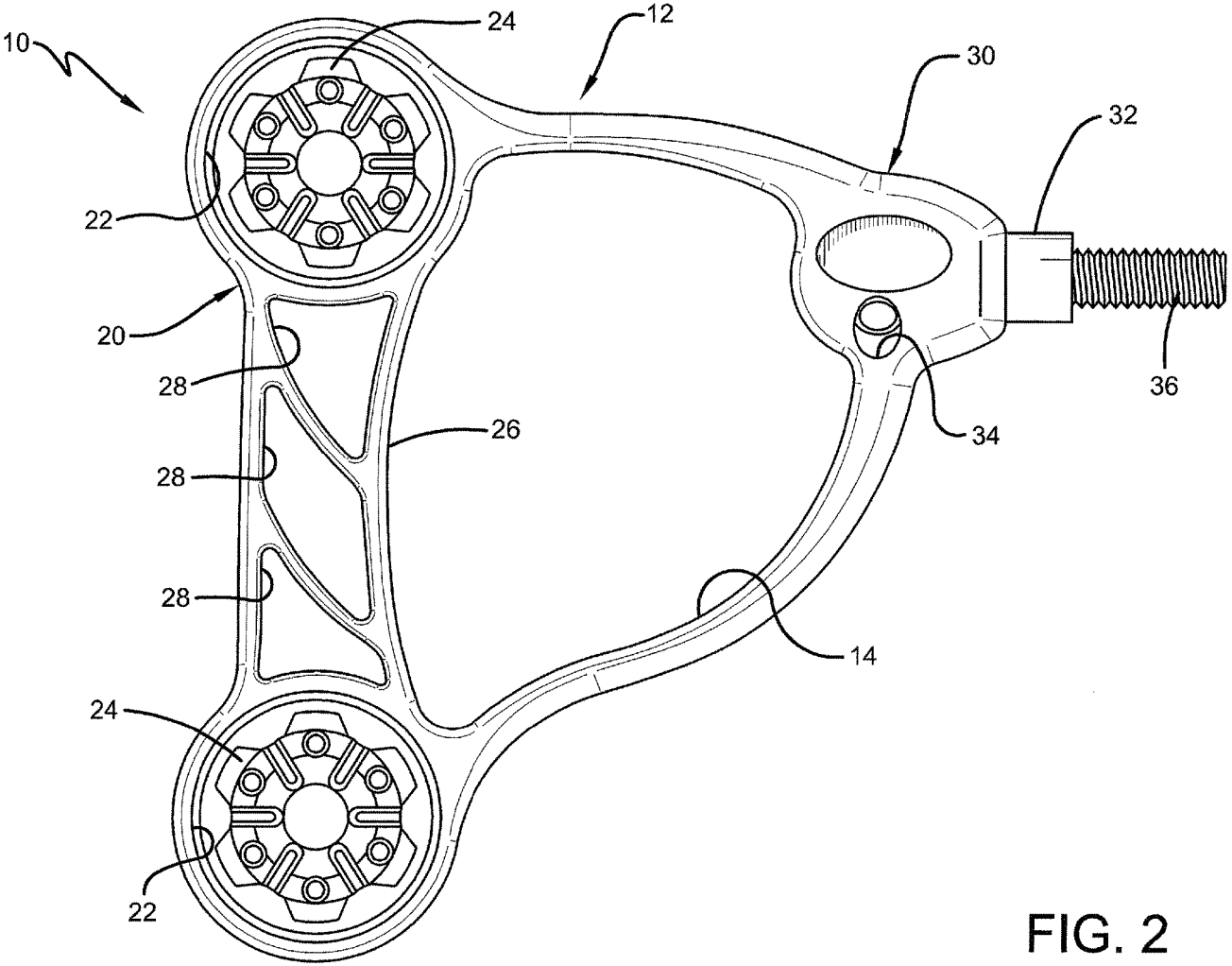
FIG. 2 is a right-side elevational view of the exemplary embodiment bow stabilizer with integral handle of the present invention shown in FIG. 1.

An exemplary embodiment bow stabilizer with integral handle of the present invention is shown in FIGS. 1-7 and is indicated generally at 10. As shown in FIGS. 6-7, exemplary embodiment bow stabilizer with integral handle 10 is utilized in conjunction with archery bow 2. With reference to FIGS. 1-2, exemplary embodiment bow stabilizer with integral handle 10 includes a generally D-shaped body 12. Body 12 includes a weight bearing portion 20 and a base portion 30. Base portion 30 and weight bearing portion 20 are integrally formed as one piece and are connected to one another in a manner that forms a transverse opening 14 within body 12.

Figure 3:
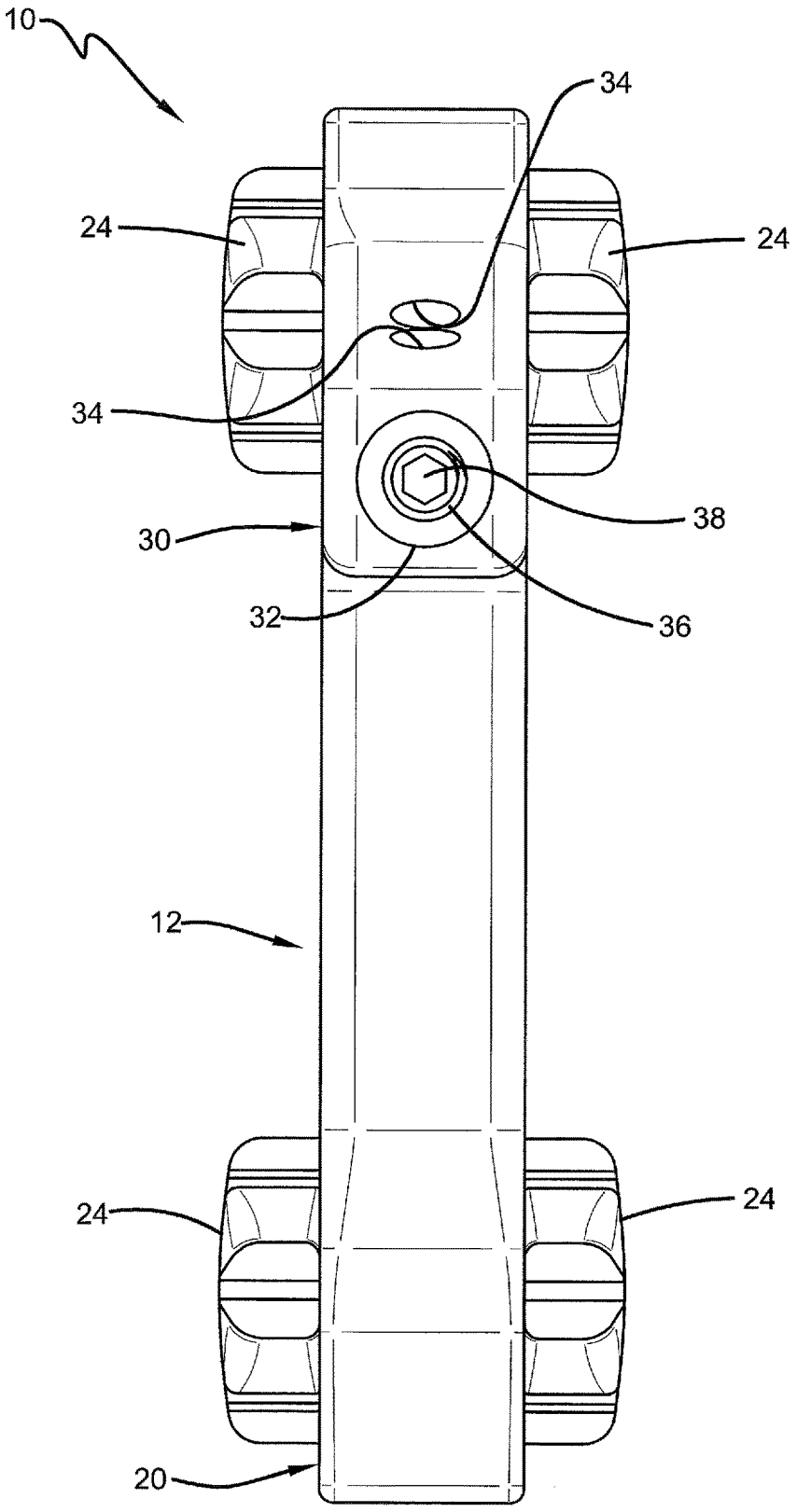
FIG. 3 is a rear elevational view of the exemplary embodiment bow stabilizer with integral handle of the present invention shown in FIG. 1.

With specific reference to FIGS. 1-3 and 5, base portion 30 of body 12 includes a bow attachment assembly 32. With particular reference to FIG. 3, bow attachment assembly 32 includes a locking stud 38 which is disposed through an opening (not shown) formed in the front of base portion 30. Locking stud 38 has a generally hexagonally cross-sectional profile and is capable of rotating within the opening formed in the front of base portion 30. Bow attachment assembly 32 includes a fastener 36 which extends distally from the front of base portion 30. Fastener 36 is threaded and threadably engages a corresponding opening (not shown) formed in the bottom one of pair of arms 5 of bow 2 to removably connect exemplary embodiment bow stabilizer with integral handle 10 to the bow (FIGS. 6-7). Exemplary embodiment bow stabilizer with integral handle 10 could utilize alternative means to removably connect the stabilizer to bow 2, such as a bracket (not shown), a coupler fitting (not shown), or other suitable means.

With reference to FIGS. 1-3, base portion 30 is formed with a plurality of adjustment openings 34. Each adjustment opening 34 extends into base portion 30 so that it connects to the opening formed in the front of the base portion through which locking stud 38 of attachment assembly 32 is disposed. An adjustment fastener (not shown) is disposed through and threadably engages each respective adjustment opening 34, the important of which will be described in detail below.

Figure 4:
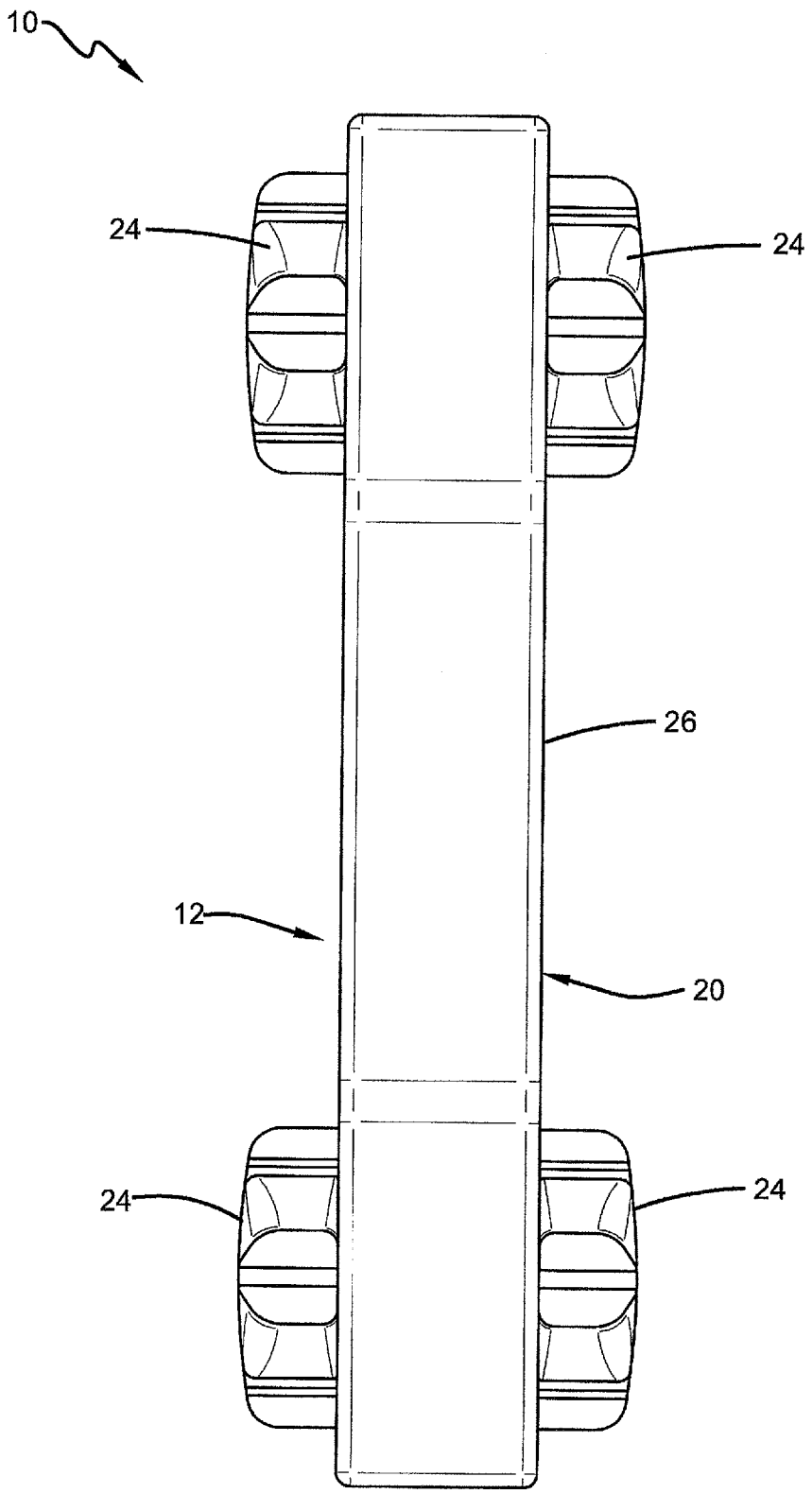
FIG. 4 is a front elevational view of the exemplary embodiment bow stabilizer with integral handle of the present invention shown in FIG. 1.
Figure 5:
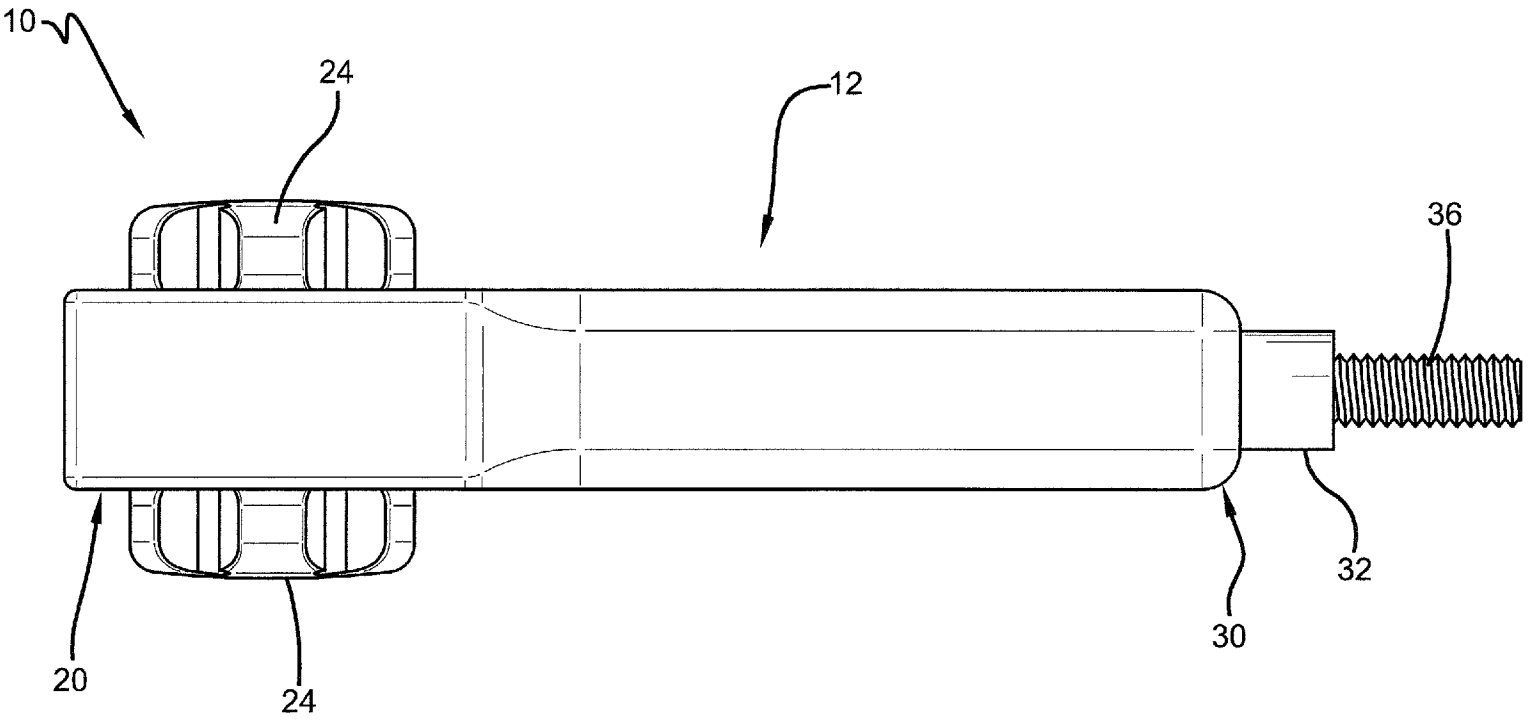
FIG. 5 is a top plan view of the exemplary embodiment bow stabilizer with integral handle of the present invention shown in FIG. 1, the bottom being the same in appearance.

With particular reference to FIGS. 1-2, weight bearing portion 20 of exemplary embodiment bow stabilizer with integral handle 10 is formed with a pair of horizontally spaced openings 22. Each one of horizontally spaced openings 22 extends transversely through weight bearing portion 20. Each horizontally space opening is formed with a pair of transversely spaced radially grooves (not shown) for removably attaching a respective dampening weight 24 to exemplary embodiment bow stabilizer with integral handle 10. More specifically, each dampening weight 24 is typically formed of a polymer, or other similar materials and includes an elastically deformable raised portion (not shown) disposed radially around the outer circumference of the dampening weight. Dampening weight 24 raised portion is capable of mating with one of the radial grooves formed within horizontally spaced opening 22. During operation, as an operator forces a dampening weight 24 within horizontally spaced opening 22, the raised portion is elastically deformed until it mates with the respective radial opening formed in horizontally spaced opening 22, at which point the raised opening elastically rebounds within the respective radial opening to mate with radial opening. As best shown in FIGS. 3-5, dampening weight 24 is mated within and frictionally and removably connected to each one of the transversely spaced radial grooves of each horizontally spaced opening 22.

With reference to FIGS. 6-7, when exemplary embodiment stabilizer with integral handle 10 is installed on archery bow 2, because weight bearing portion 20 with installed dampening weights 24 is located forwardly from archery bow 2, the vibrations created in the bow as a user pulls back on drawstring 9 are counterbalanced, which provides dampening to the vibrations and improves bow accuracy.

In accordance with an important feature of the present invention, and with reference to FIGS. 1-3, weigh bearing portion 20 of body 12 is formed with a handle 26. Handle 26 extends between horizontally aligned openings 22. Handle 26 once installed on a bow, such as archery bow 2, provides a means for a user to hold or carry a bow. More specifically, the combination of handle 26 and opening 14 of body 12 allows a bow user to insert their fingers through the opening and grasp the handle, enabling the user to hold or transport the bow during periods of non-use. When the user grasps handle 26 and allows their arm to hang naturally, the positioning of handle 26 relative to the longitudinal length of bow 2 forces a horizontal positioning and prevents the bow from dragging on the ground during holding or transport. Because handle 26 provides users the ability to hold or transport the bow, the need for an additional accessory, such as a carrying strap, to provide the same is eliminated. In addition, handle 26 is formed with a plurality of cutouts 28, which reduces the amount of material required to manufacture exemplary embodiment bow stabilizer with integral handle 10 and the overall weight of the stabilizer.

In accordance with another important feature of exemplary embodiment bow stabilizer with integral handle 10, the bow stabilizer body 12 once removably attached to bow 2 can be rotated and locked offset relative to the longitudinal length of bow 2. More specifically, locking stud 38 is capable of rotating both clockwise and counterclockwise within the opening formed within base portion 30 when unhindered by the adjustment fasteners disposed within and threadably engaging their respective adjustment opening 34. In operation, once exemplary embodiment bow stabilizer with integral handle 10 is removably connected to bow 2, a bow user can loosen one or more of the adjustment fastener disposed and threadably engaging their respective adjustment opening 34 to allow free rotation of body 12 relative to the longitudinal length of bow 2. Once the desired positioning of body 12 relative to bow 2 is achieved, the user can lock exemplary embodiment bow stabilizer at the desired positioning by tightening the adjustment fastener in their respective adjustment opening 34. Because each adjustment opening 34 is in communication with the stud opening formed in base portion 30 and locking stud 38 has a hexagonal cross-sectional profile, as the adjustment fasteners are tightened, they contact locking stud 38 disposed through the opening and lock the locking stud, preventing rotational movement of the locking stud within the stud opening. Because body 12 can be locked offset relative to the longitudinal length of bow 2, a user can optimize damping provided by exemplary embodiment bow stabilizer with integral handle 10 for varying bow configurations.

It is contemplated that exemplary embodiment bow stabilizer with integral handle 10 of the present invention, including components thereof, could have other shapes and sizes without changing the overall concept or operation of the present invention. It is further contemplated that exemplary embodiment bow stabilizer with integral handle 10 of the present invention could be utilized with other types of connectors to attach the stabilizer to a bow, without changing the overall concept or operation of the present invention. It is also contemplated that exemplary embodiment bow stabilizer with integral handle 10 of the present invention could be located at any position on the bow riser, extending forwardly, rearwardly or in a sideways direction, without changing the overall concept or operation of the present invention. It is further contemplated that dampening weights with alternative designs could be utilized with exemplary embodiment bow stabilizer with integral handle 10, such as those including interchangeable weights, without changing the concept or operation of the present invention. It is also contemplated that exemplary embodiment bow stabilizer with integral 10 could utilize alternative constructions, such as a multi-piece construction without changing the overall concept or operation of the present invention.

Accordingly, the bow stabilizer with integral carry handle of the present invention is simplified, provides an effective, safe, inexpensive, and efficient structure which achieves all the enumerated objectives, provides for eliminating difficulties encountered with prior art bow stabilizers, and solves problems and obtains new results in the art.

In the foregoing description, certain terms have been used for brevity, clarity and understanding; but no unnecessary limitations are to be implied therefrom beyond the requirements of the prior art, because such terms are used for descriptive purposes and are intended to be broadly construed. Moreover, the present invention has been described with reference to a specific embodiment. It shall be understood that this illustration is by way of example and not by way of limitation, as the scope of the invention is not limited to the exact details shown or described. Potential modifications and alterations will occur to others upon a reading and understanding of this disclosure, and it is understood that the invention includes all such modifications and alterations and equivalents thereof.

Having now described the features, discoveries and principles of the invention, the manner in which the vibration dampener of the present invention is constructed, arranged and used, the characteristics of the construction and arrangement, and the advantageous, new and useful results obtained; the new and useful structures, devices, elements, arrangements, parts and combinations are set forth in the appended claims.

What is claimed is:

1. A stabilizer for an archery bow comprising:

A body capable of being removably attached to said archery bow, said body providing dampening to said archery bow when the body is removably attached to the archery bow, said body including a handle that enables the bow to be held or transported, said body including an attachment assembly, said attachment assembly including a fastener to removably attach the body to said bow, said fastener threadably engaging a corresponding opening formed in said bow, said attachment assembly also including a stud, said stud being disposed into said body, said body being rotatable around the stud to allow the body to be rotated offset relative to a longitudinally length of said bow, said body capable of being locked onto said stud at a position offset relative said bow longitudinal length, said stud including a hexagonal cross-sectional profile.

* * * * *